US011032646B2

(12) United States Patent
Walther et al.

(10) Patent No.: US 11,032,646 B2
(45) Date of Patent: Jun. 8, 2021

(54) AUDIO PROCESSOR, SYSTEM, METHOD AND COMPUTER PROGRAM FOR AUDIO RENDERING

(71) Applicant: Fraunhofer-Gesellschaft zur Foerderung der angewandten Forschung e.V., Munich (DE)

(72) Inventors: Andreas Walther, Feucht (DE); Jürgen Herre, Erlangen (DE); Christof Faller, Greifensee (CH); Julian Klapp, Erlangen (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 0 days.

(21) Appl. No.: 16/664,520

(22) Filed: Oct. 25, 2019

(65) Prior Publication Data

US 2020/0059724 A1 Feb. 20, 2020

Related U.S. Application Data

(63) Continuation of application No. PCT/EP2018/000114, filed on Mar. 23, 2018.

(30) Foreign Application Priority Data

May 3, 2017 (EP) ..... 17169333

(51) Int. Cl.
*H04R 5/04* (2006.01)
*H04R 3/12* (2006.01)
(Continued)

(52) U.S. Cl.
CPC ..... *H04R 5/04* (2013.01); *H04R 3/12* (2013.01); *H04R 5/02* (2013.01); *H04S 7/303* (2013.01); *H04S 7/307* (2013.01); *H04S 2420/01* (2013.01)

(58) Field of Classification Search
CPC .... H04R 5/04; H04R 3/12; H04R 5/02; H04S 7/303; H04S 7/307; H04S 2420/01
See application file for complete search history.

(56) References Cited

U.S. PATENT DOCUMENTS 5,910,990 A 6/1999 Jang
6,798,889 B1 9/2004 Dicker et al.
(Continued)

FOREIGN PATENT DOCUMENTS

CN 101032187 A 9/2007
CN 102687536 A 9/2012
(Continued)

OTHER PUBLICATIONS

Bacch™ 3D Sound invented@Princeton University, A Revolutionary Technology for Audiophile-Grade 3D Audio, An Introduction through 20 Questions and Answers, https://www.princeton.edu/3D3A/PureStereo/Pure_Stereo.html.
(Continued)

*Primary Examiner* — Andrew L Sniezek
(74) *Attorney, Agent, or Firm* — Michael A. Glenn; Perkins Coie LLP

(57) ABSTRACT

An audio processor configured for generating, for each of a set of one or more loudspeakers, a set of one or more parameters, which determine a derivation of a loudspeaker signal to be reproduced by the respective loudspeaker from an audio signal, based on a listener position and loudspeaker position of the set of one or more loudspeakers. The audio processor is configured to base the generation of the set of one or more parameters for the set of one or more loudspeakers on a loudspeaker characteristic of at least one of the set of one or more loudspeakers.

19 Claims, 4 Drawing Sheets

(51) Int. Cl.

| | |
|---|---|
| ***H04R 5/02*** | (2006.01) |
| ***H04R 7/00*** | (2006.01) |
| ***H04S 7/00*** | (2006.01) |

(56) References Cited

U.S. PATENT DOCUMENTS

| | | | | |
|---|---|---|---|---|
| 2002/0034308 | A1 | 3/2002 | Usui et al. | |
| 2006/0088174 | A1 | 4/2006 | Deleeuw et al. | |
| 2007/0070839 | A1 | 3/2007 | Song et al. | |
| 2008/0273713 | A1* | 11/2008 | Hartung | H04S 7/30 381/86 |
| 2010/0226499 | A1 | 9/2010 | De et al. | |
| 2010/0260360 | A1* | 10/2010 | Strub | H04S 7/301 381/303 |
| 2011/0081024 | A1 | 4/2011 | Soulodre | |
| 2011/0081032 | A1 | 4/2011 | Soulodre | |
| 2012/0148075 | A1 | 6/2012 | Goh et al. | |
| 2012/0328135 | A1 | 12/2012 | De Bruijn et al. | |
| 2014/0180684 | A1 | 6/2014 | Strub | |
| 2016/0134989 | A1* | 5/2016 | Herre | H04S 7/303 381/20 |
| 2017/0034642 | A1 | 2/2017 | Takahashi | |

FOREIGN PATENT DOCUMENTS

| | | | |
|---|---|---|---|
| CN | 104980845 | A | 10/2015 |
| CN | 105210387 | A | 12/2015 |
| EP | 2830332 | A2 | 1/2015 |
| JP | 2002095096 | A | 3/2002 |
| JP | 3421799 | | 6/2003 |
| KR | 20090007386 | A | 1/2009 |
| NO | 2013105413 | A1 | 7/2013 |
| RU | 2575883 | C2 | 4/2014 |

OTHER PUBLICATIONS

Merchel, Sebastian , et al., "Adaptively Adjusting the Stereophonic Sweet Spot to the Listener's Position", J. Audio Eng. Soc., (20101000), vol. 58, No. 10, XP040567070.

* cited by examiner

AUDIO PROCESSOR, SYSTEM, METHOD AND COMPUTER PROGRAM FOR AUDIO RENDERING

CROSS-REFERENCE TO RELATED APPLICATIONS

This application is a continuation of copending International Application No. PCT/EP2018/000114, filed Mar. 23, 2018, which is incorporated herein by reference in its entirety, and additionally claims priority from European Application No. 17 169 333.6, filed May 3, 2017, which is also incorporated herein by reference in its entirety.

BACKGROUND OF THE INVENTION

Embodiments according to the invention relate to an audio processor, a system, a method and a computer program for audio rendering.

A general problem in audio reproduction with loudspeakers is that usually reproduction is optimal only within one or a small range of listener positions. Even worse, when a listener changes position or is moving, then the quality of the audio reproduction highly varies. The evoked spatial auditory image is unstable for changes of the listening position away from the sweet-spot. The stereophonic image collapses into the closest loudspeaker.

This problem has been addressed by previous publications, including [1] by tracking a listener's position and adjusting gain and delay to compensate deviations from the optimal listening position. Listener tracking has also been used with cross talk cancellation (XTC), see, for example, [2]. XTC uses extremely precise positioning of a listener, which makes listener tracking almost indispensable.

Previous methods do not consider the directivity pattern of loudspeakers and the associated potential for the quality of the compensation process. A loudspeaker emits sound in different directions and thus reaches listeners at different positions, resulting in different audio perception for the listeners at different positions. Usually loudspeakers have different frequency responses for different directions. Thus, different listener positions are served by a loudspeaker with different frequency responses.

Therefore, it is desired to get a concept which involves a compensation of an undesired frequency response of a loudspeaker for the aim to optimizing the quality of an output audio signal of a loudspeaker for a listener at different listening positions.

SUMMARY

An embodiment may have an audio processor configured for generating, for each of a set of one or more loudspeakers, a set of one or more parameters, which determine a derivation of a loudspeaker signal to be reproduced by the respective loudspeaker from an audio signal, based on a listener position and loudspeaker positioning of the set of one or more loudspeakers, wherein the loudspeaker positioning defines the position and orientation of the loudspeakers; wherein the audio processor is configured to base the generation of the set of one or more parameters for the respective loudspeaker of the set of one or more loudspeakers on a loudspeaker characteristic of at least one of the set of one or more loudspeakers, wherein the loudspeaker characteristic represents an emission-angle dependent frequency response of an emission characteristic of the at least one of the set of one or more loudspeakers, and wherein the audio processor is configured to set each set of one or more parameters separately depending on an angle at which the listener position resides relative to a respective loudspeaker axis of the respective loudspeaker of the set of one or more loudspeakers.

Another embodiment may have a system having the inventive audio processor as mentioned above, the set of one or more loudspeakers and, for each set of one or more loudspeakers, a signal modifier for deriving the loudspeaker signal to be reproduced by the respective loudspeaker from an audio signal using a set of one or more parameters generated for the respective loudspeakers by the audio processor.

Another embodiment may have a method for operating an audio processor, wherein a set of one or more parameters are generated, for each of a set of one or more loudspeakers, which determine a derivation of a loudspeaker signal to be reproduced by the respective loudspeaker from an audio signal, based on a listener position and loudspeaker positioning of the set of one or more loudspeakers, wherein the loudspeaker positioning defines the position and orientation of the loudspeakers; wherein the audio processor bases the generation of the set of one or more parameters of the respective loudspeaker of the set of one or more loudspeakers on a loudspeaker characteristic of at least one of the set of one or more loudspeakers, wherein the loudspeaker characteristic represents an emission-angle dependent frequency response of an emission characteristic of the at least one of the set of one or more loudspeakers, and wherein the audio processor sets each set of one or more parameters separately depending on an angle at which the listener position resides relative to a respective loudspeaker axis of the respective loudspeaker of the set of one or more loudspeakers.

Yet another embodiment may have a non-transitory digital storage medium having stored thereon a computer program for performing a method for operating an audio processor, wherein a set of one or more parameters are generated, for each of a set of one or more loudspeakers, which determine a derivation of a loudspeaker signal to be reproduced by the respective loudspeaker from an audio signal, based on a listener position and loudspeaker positioning of the set of one or more loudspeakers, wherein the loudspeaker positioning defines the position and orientation of the loudspeakers; wherein the audio processor bases the generation of the set of one or more parameters of the respective loudspeaker of the set of one or more loudspeakers on a loudspeaker characteristic of at least one of the set of one or more loudspeakers, wherein the loudspeaker characteristic represents an emission-angle dependent frequency response of an emission characteristic of the at least one of the set of one or more loudspeakers, and wherein the audio processor sets each set of one or more parameters separately depending on an angle at which the listener position resides relative to a respective loudspeaker axis of the respective loudspeaker of the set of one or more loudspeakers, when said computer program is run by a computer.

An embodiment according to this invention is related to an audio processor configured for generating, for each of a set of one or more loudspeakers, a set of one or more parameters (this can, for example, be parameters, which can influence the delay, level or frequency response of one or more audio signals), which determine a derivation of a loudspeaker signal to be reproduced by the respective loudspeaker from an audio signal, based on a listener position (the listener position can, for example, be the position of the whole body of the listener in the same room as the set of one or more loudspeakers, or, for example, only the head position of the listener or also, for example, the position of the ears of the listener. The listener position doesn't have to be an alone standing position in a room, it can also, for example, be a position in reference to the set of one or more loudspeakers, for example, a distance of the listener's head to the set of one or more loudspeakers) and loudspeaker position of the set of one or more loudspeakers. The audio processor is configured to base the generation of the set of one or more parameters for the set of one or more loudspeakers on a loudspeaker characteristic. The loudspeaker characteristic may, for instance, be an emission-angle dependent frequency response of an emission characteristic of the at least one of the set of one or more loudspeakers, this means the audio processor may perform the generation dependent on the emission-angle dependent frequency response of the emission characteristic of the at least one of the set of one or more loudspeakers. This may alternatively be done for more than one (or even all loudspeakers) of the set of one or more loudspeakers.

An insight on which the application is based is that the loudspeaker's frequency response changes at different directions (relative to on-axis forward direction) so that the rendering quality is affected by this directional dependency, but that this quality decrease may be reduced by taking the loudspeaker characteristic into account in the rendering process. The frequency response of the one or more loudspeakers towards the listener position can be, for example, equalized to match the frequency response of the one or more loudspeakers as it would be in an ideal or predetermined listening position. This can be realized with the audio processor. The audio processor gets, for example, information about the listener positioning, the loudspeaker positioning and the loudspeaker radiation characteristics, such as, for example, the loudspeaker's frequency response. The audio processor can calculate out of this information a set of one or more parameters. With the set of one or more parameters, the input audio, alternatively speaking of the incoming audio signal, can be modified. With this modification of the audio signal, the listener receives at his position an optimized audio signal. With this optimized signal, the listener can, for example, have in his position nearly or completely the same hearing sensation as it would be in the listener's ideal listening position. The ideal listener position is, for example, the position at which a listener experiences an optimal audio perception without any modification of the audio signal. This means, for example, that the listener can perceive at this position the audio scene in a manner intended by the production site. The ideal listener position can correspond to a position equally distant from all loudspeakers (one or more loudspeakers) used for reproduction.

Therefore, the audio processor according to the present invention allows the listener to change his/her position to different listener positions and have at each, at least at some, positions the same, or at least partially the same, listening sensation as the listener would have in his ideal listening position.

In summary, it should be noted that the audio processor is able to adjust at least one of delay, level or frequency response of one or more audio signals, based on the listener positioning, loudspeaker positioning and/or the loudspeaker characteristic, with the aim of achieving an optimized audio reproduction for at least one listener.

BRIEF DESCRIPTION OF THE DRAWINGS

The drawings are not necessarily to scale, emphasis instead generally being placed upon illustrating the principles of the invention. In the following description, various embodiments of the invention are described with reference to the following drawings, in which.

DETAILED DESCRIPTION OF THE INVENTION

Figure 1:
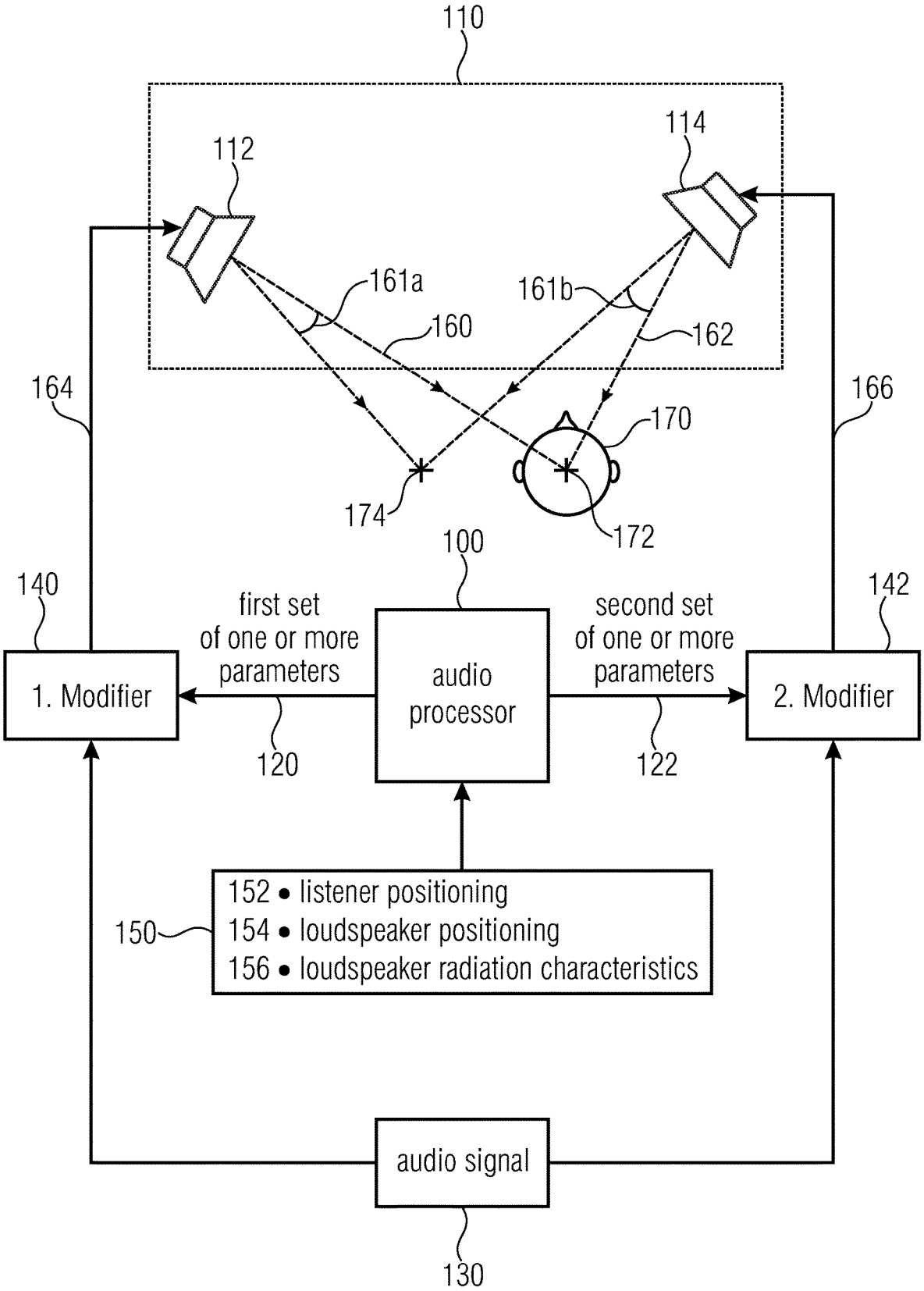
FIG. 1 shows a schematic view of an audio processor according to an embodiment of the present invention.

FIG. 1 shows a schematic view of an audio processor 100 according to an embodiment of the present invention.

The audio processor 100 is configured for generating, for each of a set 110 of loudspeakers, a set of one or more parameters. This means, for example, that the audio processor 100 generates a first set of one or more parameters 120 for a first loudspeaker 112 and a second set of one or more parameters 122 for a second loudspeaker 114. The set of one or more parameters determine a derivation of a loudspeaker signal (for example, a first loudspeaker signal 164 transferred form the first modifier 140 to the first loudspeaker 112 and/or a second loudspeaker signal 166 transferred from the second modifier 142 to the second loudspeaker 114) to be reproduced by the respective loudspeaker from an audio signal 130. This means, for example, that the audio signal 130 gets modified by the first modifier 140, based on the first set of one or more parameters 120, to the first loudspeaker 112 and modified by the second modifier 142, based on the second set of one or more parameters 122, to the second loudspeaker 114. The audio signal 130 has, for example, more than one channel, i.e. may be a stereo signal or multi-channel signal such as an MPEG surround signal. The audio processor 100 bases the generation of the first set of one or more parameters 120 and the second set of one or more parameters 122 on incoming information 150. The incoming information 150 can, for example, be the listener positioning 152, the loudspeaker positioning 154 and/or the loudspeaker radiation characteristics 156. The audio processor 100 needs, for example, to know the loudspeaker positioning 154, which can, for example, be defined as the position and orientation of the loudspeakers. The loudspeaker characteristics 156 can, for example, be frequency responses in different directions or loudspeaker directivity patterns. Those can, for example, be measured or taken from databases or approximated by simplified models. Optionally, the effect of a room may be included with loudspeaker characteristics (when the data is measured in a room, this is automatically the case). Based on the above three inputs (listener positioning 152, loudspeaker positioning 154, and loudspeaker characteristics 156 (loudspeaker radiation characteristics)), modifications for the input signals (audio signal 130) are derived.

In an embodiment the set of one or more parameters (120, 122) define a shelving filter. The set of one or more parameters (120, 122) may be fed to a model to derive the loudspeaker signal (164, 166) by a desired correction of the audio signal 130. The type of modification (or correction) can, for example, be an absolute compensation or a relative compensation. At the absolute compensation the transfer function, between loudspeaker position 154 and listener positioning 152 is, for example, compensated on a per loudspeaker basis relative to a reference transfer function which can, for example, be the transfer function from a respective loudspeaker to a listener position on its loudspeaker axis at a certain distance (for example, on-axis direction defined as equally distant from all loudspeakers). That is, whatever listener position 172 is chosen—within a certain allowed positioning region—by listener positioning 152, the effective transfer function will, for example, evoke the same or almost the same audio perception for the listener, as the reference transfer function would at the ideal listener position 174. In other words the first modifier 140 and the second modifier 142 spectrally pre-shape the inbound audio signal 130 using a respective transfer function which is set dependent on respectively the set of one or more parameters 120 and 122, respectively, and the latter parameters are set by the audio processor 100 to adjust the spectral pre-shaping to compensate the respective loudspeaker's deviation of its transfer function to its listener position 172 of its reference transfer function. For instance the audio processor 100 may perform the setting of the parameters 120 and 122 separately depending on an absolute angle at which the listener position 172 resides relative to the respective loudspeaker axis, i.e. parameters 120 depending on the absolute angle 161*a* of the first loudspeaker 112 and the second set 122 of one or more parameters depending on the absolute angle 161*b* of the second loudspeaker 114. The setting can be performed by table look-up using the respective absolute angle or analytically. At the relative compensation, for example, differences between the transfer functions of different loudspeakers to a current listener position 172 are compensated, or the differences of the transfer functions between different loudspeakers and the listener's left and right ears. FIG. 1 for instance illustrates a symmetric positioning of loudspeakers 112 and 114 where the audio output 160 of the first loudspeaker 112 and the audio output 162 of the second loudspeaker 114 have, for example, no transfer function difference at listener position symmetrically between loudspeaker 112 and 114 such as the position 174. That is, at these positions, the transfer function from speaker 112 to the respective position is equal to the transfer function from speaker 114 to the respective position. A transfer function difference emerges however for any listener position 172 located offset to the symmetry axis. At the relative compensation, for example, the modifier for one loudspeaker (for example, either the first loudspeaker 112 or the second loudspeaker 114) of the set 110 of loudspeakers compensates the difference of the one speaker's transfer function to the listener position 172 relative to the transfer function of the other loudspeaker(s) to the listener position 172. Thus, according to the relative compensation, the audio processor 100 sets the sets of parameter 120/122 in a manner so that for at least one speaker, the audio signal is spectrally pre-shaped in a manner so that its effective transfer function to the listener position 172 gets nearer to the other speaker's transfer function. The setting may be done, for instance, using a difference between the absolute angles at which the listener position 172 resides relative to the speakers 112 and 114. The difference may be used for table look-up of the set of parameters 120 and/or 122, or as a parameter for analytically computing the set 120/122. Thus the audio output 160 of the first loudspeaker 112 is, for example, modified with respect to the audio output 162 of the second loudspeaker 114 such that the listener 170 perceives at listener position 172 the same or nearly the same audio perception as some corresponding position along the aforementioned symmetry axis (for example, the ideal listener position). Naturally, the relative compensation is not bound to symmetric speaker arrangements.

Thus, the generation of the set of one or more parameters by the audio processor 100 has the effect, that the audio signal 130 is modified by the first modifier 140 and the second modifier 142 such that the audio output 160 of the first loudspeaker 112 and the audio output 162 of the second loudspeaker 114 give the listener 170 at his listener position 172 completely (at least partially) the same sound perception as if the listener 170 is located at the ideal listener position 174. According to this embodiment, the listener 170 doesn't have to be in the ideal listener position 174 to receive an audio output, which generates an auditory image for the listener 170 to resemble the perception at the ideal listener position 174. Thus, for example, the auditory perception of the listener 170 does not or hardly change with a change of the listener position 172, only the electrical signal, for example, the first loudspeaker signal 164 and/or the second loudspeaker signal 166, changes. The auditory image perceived by the listener at each listener position 172 is similar to the original auditory image as intended by the producer of the audio signal 130. Thus, the present invention optimizes the perception of the listener 170 of the output audio signal of the set 110 of loudspeakers at different listener positions 172. This has the consequence that the listener 170 can take over different positions in the same room as the set 110 of loudspeakers and perceive nearly the same quality of the output audio signal.

In an embodiment for each loudspeaker of the set 110 of loudspeakers the set of one or more parameters determines the derivation of the loudspeaker signal, from the inbound audio signal 130. For example, the first loudspeaker signal 164 and/or the second loudspeaker signal 166 to be reproduced is derived by modifying the audio signal 130 by delay modification, amplitude modification and/or a spectral filtering. The modification of the audio signal 130 can, for example, be accomplished by the first modifier 140 and/or the second modifier 142. It is, for example, possible that only one modifier performs the modification of the audio signal 130 for the set 110 of loudspeakers or that more than two modifiers perform the modification. If more than one modifier is present the modifiers might, for example, exchange data with each other and/or one modifier is the base and the other modifiers (at least one other modifier) perform the modification relative to the modification of the base (for example, by subtraction, addition, multiplication and/or division). The first modifier 140 does not necessarily have to use the same modification as the second modifier 142. For different listener positioning 152, loudspeaker positioning 154 and/or loudspeaker radiation characteristics 156, the modification of the audio signal 130 can differ.

As described further below, the loudspeaker's frequency response towards the direction of the listener position 172 is taken into account for rendering processes. The frequency response of the loudspeaker towards the listener position 172 is equalized, for example, to match the frequency response of the loudspeaker as it would be in the ideal listening position 174. For conventional loudspeakers with transducers that point forward, this equalization would be relative to the on-axis (zero degrees forward) response of the first loudspeaker 112 and/or the second loudspeaker 114. For other systems (for example loudspeakers built into TV sets, pointing sideways), this equalization would be relative to the frequency response as measure at the ideal listening position 174. This equalization of the frequency response can, for example, be accomplished by spectral filtering.

For completeness it should be mentioned, that the frequency characteristic at the sweet spot (for example, at the ideal listener position 174) does not have to be the factory default characteristic of the loudspeakers (the first loudspeaker 112 and the second loudspeaker 114) of the set 110 of loudspeakers, but can already be an equalized version (e.g. specific equalization for the current playback room). That is, the speakers 112 and 114 may have, internally, built-in equalizers, for instance.

It may be favorable to only partially correct the loudspeaker frequency response, for example, if the frequency response towards the listener position 172 is 6 dB lower than on-axis, one may decide to correct not the full 6 dB, but only parts of it, for example, 3 dB (denoted partial correction in the following). The modification by the first modifier 140 and/or the second modifier 142 is based on the set of one or more parameters which are generated by audio processor 100. The first modifier gets a first set of one or more parameters 120 and the second modifier 142 gets the second set of one or more parameters 122 of the audio processor 100. The first set of one or more parameters 120 and/or the second set of one or more parameters 122 define how the audio signal 130 should, for example, be modified by delay modification, amplitude modification and/or a spectral filtering. The calculation of the set of one or more parameters by the audio processor is based on the incoming information 150 which can, for example, be a listener positioning 152, the loudspeaker positioning 154, the loudspeaker radiation characteristics 156, additionally it can also be the room acoustic in which the set 110 of loudspeakers is installed.

Thus, the first modifier 140 and/or the second modifier 142 are able to modify the audio signal 130 such that the output audio signal by the first loudspeaker 112 and the second loudspeaker 114 is optimized based on the incoming information 150.

The audio processor 100 is configured to perform the generation of the set of one or more parameters for the set 110 of loudspeakers, for example to modify the input signals such that, for example, frequency responses of the set 110 of loudspeakers are adjusted to compensate frequency response variations due to different angles at which the different loudspeakers emit sound towards the listening position 172. In addition to the loudspeaker's frequency response at the angle towards the listener position 172, the frequency response at which sound reaches the listener 170 also depends on the room acoustic. Two solutions can address this additional complexity. A first solution can, for example, be the before mentioned partial correction, since frequency response at a listener is only partially loudspeaker determined. Thus a partial correction makes sense. A second solution can, for example, be a correction by the first modifier 140 and/or the second modifier 142 which not only considers loudspeaker frequency responses (loudspeaker radiation characteristics 156) but also room responses. The audio processor 100 can also, for example, be configured to perform the generation of the set of one or more parameters for the set 110 of loudspeakers such that levels are adjusted to compensate level differences due to distance differences between the different loudspeakers and listener positions 172. The audio processor 100 is also configured, for example, to perform the generation of the set of one or more parameters for the set of loudspeakers such that delays are adjusted to compensate delay differences due to distance differences between the different loudspeakers and listener position 172 and/or to perform the generation of the set of one or more parameters for the set of loudspeakers such that a repositioning of elements in the sound mix is applied to render a sound image at a desired positioning. The rendering of the sound image can be easily achieved with state-of-the-art object-based audio representations (for legacy (channel-based) representations, signal decomposition methods have to be applied). Thus with the present invention it is not only possible to optimize the listening sensation for the listener 170 in each position but it is also possible to rearrange the sound image in such a way that, for example, individual instruments can be perceived out of different directions.

In an embodiment, the audio processor 100 can also, for example, be configured such that the set of one or more parameters for the at least one loudspeaker (for example, the first loudspeaker 112 and/or the second loudspeaker 114) is adjusted so that the loudspeaker signal (for example, the first loudspeaker signal 164 and/or the second loudspeaker signal 166) of the at least one loudspeaker is derived from the audio signal 130 to be reproduced by spectral filtering with a transfer function which compensates a deviation of a frequency response of an emission characteristic (loudspeaker radiation characteristics 156) of the at least one loudspeaker into a direction pointing from the loudspeaker position of the at least one loudspeaker to the listener position 172 from the frequency response of the emission characteristic (loudspeaker radiation characteristics 156) of the at least one loudspeaker into a predetermined direction. Thus, the audio processor 100 uses the incoming information 150 of the loudspeaker radiation characteristics 156 to generate a first set of one or more parameters 120 and/or a second set of one or more parameters 122. This can, for example, mean that the listener positioning 152 and the loudspeaker positioning 154 is such that the loudspeaker radiation characteristics 156 show a frequency response where, for example, high frequencies have a lower level than they would have in the ideal listening position 174. In this case, the audio processor can generate out of this incoming information 150 a first set of one or more parameters 120 and a second set of one or more parameters 122 with which, for example, the first modifier 140 and/or the second modifier 142 can modify the audio signal 130 with a transfer function which compensates a deviation of a frequency response. The transfer function can, therefore, for example, be defined by a level modification, where the level of the high frequencies is adjusted to the level of the high frequencies at the optimal listener position 172. Thus, the listener 170 receives an optimized output audio signal. The loudspeaker characteristics (loudspeaker radiation characteristics 156) can be frequency responses in different directions or loudspeaker directivity patterns, for example. Those can be provided or approximated by a model, measured, taken from databases provided by a hardware, cloud or network or can be calculated analytically. The incoming information 150, like the loudspeaker radiation characteristics 156, can be transferred to the audio processor via a connection or wireless. Optionally, the effect of a room may be included with loudspeaker characteristics (when the data is measured in a room, this is automatically the case). It is, for example, not necessary to have the exact loudspeaker radiation characteristics 156, instead also parameterized approximations are sufficient.

The audio processor 100 also needs to know the position of the listener (listener positioning 152).

In an embodiment, the listener positioning 152 defines a listener's horizontal position. This means, for example, that the listener 170 is laying while he listens to the audio output. The audio output has to be differently modified by, for example, the first modifier 140 and/or the second modifier 142, when the listener 170 is in a horizontal position instead of a vertical position, or if the listener 170 changes the listening position 172 in a horizontal direction instead of a vertical direction. The horizontal position 172 changes, for example, if the listener 170 walks from one side of a room, with the set 110 of loudspeakers, to the other side. It is also, for example, possible that more than one listener 170 is present in the room. Therefore, for example, if two listeners 170 are present in the room they have different horizontal positions but not necessarily different vertical positions (for example, when both listeners 170 have nearly the same height). Thus if the listener positioning 152 defines a listener's horizontal position the listener positioning 152 is, for example, simplified and the first loudspeaker signal 164 and/or the second loudspeaker signal 166 to optimize an audio image of the listener 170 can be calculated very fast by, for example, the first modifier 140 and/or the second modifier 142.

In another embodiment, the listener position 172 (listener positioning 152) defines a listener's 170 head position in three-dimension. With this definition of the listener positioning 152 the position 172 of the listener 170 is precisely defined. The audio processor knows, for example, where the optimal audio output should be directed to. The listener 170 can, for example, change his listener position 172 in a horizontal and vertical direction at the same time. Thus with a listener position defined in three-dimension, for example, not only a horizontal position is tracked, but also a vertical position. A change of the vertical position of a listener 170 can occur, when the listener 170, for example, changes from a standing position into a sitting position or laying position. The vertical position of different listeners 170 can also depend on their height, for example, a child has a much smaller height than a grown up listener. Thus with a three-dimensional listener position 172 an audio image produced by the loudspeakers 112 and 114 for the listener 170 is optimized.

In another embodiment, the listener position 172 defines a listener's head position and head orientation. To enhance the performance of the processing for specific use case scenarios, additionally the orientation ("look direct") of the listener can be used to account for changes in the frequency response due to changing HRTFs/BRIRs when the listener's head is rotated.

The listener position 172 can also, for example, be tracked in real time. In an embodiment, the audio processor can, for example, be configured to receive the listener position 172 in real time, and adjust delay, level and frequency responses in real time. With this implementation, the listener doesn't have to be static in the room, instead he can also walk around and hear in each of the positions an optimized audio output as if the listener 170 is in the ideal listening position 174.

In another embodiment according to the present invention, the audio processor 100 supports multiple predefined positions (listener positioning 152), wherein the audio processor 100 is configured to perform the generation of the set of one or more parameters for the set 110 of loudspeakers by precomputing the set of one or more parameters for the set 110 of loudspeakers for each of the multiple predefined positions (listener positioning 152). Thus, for example, multiple different listener positions 172 can be predefined and the listener can select between them depending on where the listener 170 currently is. The listener position 172 (listener positioning 152) can also be read once as a parameter or measurement. The predefined positions enhance the performance for static listeners that are not positioned in the sweet-spot (optimal/ideal listener position 174).

In another embodiment according to the present invention the listener positioning 152 comprises or defines the position data of two or more listeners 170 or defines more than one listener position 172 with respect to which the compensation shall take place. The audio processor, in such a case, calculates, for instance, a (best effort) average playback for all such listener positions 172. This is, for example, the case, when more than one listener 170 is in the room of the set 110 of loudspeakers, or the listener 170 shall have the opportunity to move in an area over which the listener positions 172 are spread. Therefore, the modification of the audio signal 130 would be done with the aim to achieve nearly optimal hearing experience at several positions 172 or an area within which such positions are spread. This is, for example, accomplished by optimization of the sets 120/122 according to some averaged cost function averaging transfer function differences mentioned above over the different listener positions 172.

In another embodiment, the audio processor 100 is configured to receive the incoming information 150 (for example, the listener positioning 152) from a sensor configured to acquire the listener positioning 152 (optionally the orientation) by a camera (for example, a video), a gyrometer, an accelerometer, acoustic sensors, etc., and/or a combination of the above. With this implemented sensor the usage of the audio system for the listener 170 is simplified. The listener 170 doesn't need to adjust any settings of the audio system to hear at his listener position 172 with at least partially the same quality as if the listener would be at the ideal listening position 174. The audio processor 100, for example, (at least at some time points) gets the incoming information 150 from a sensor and can thus, based on the incoming information 150 generate the set of one or more parameters.

In an embodiment, the set of one or more parameters, generated by the audio processor 100, defines a shelving filter. The usage of shelving filters (or a reduced number of peak-EQs) is a low complexity implementation of the system to approximate the exact equalization that would be needed. It is also possible to use fractional delays. The shelving filters and/or the fractional delay filters can, for example, be implemented in the first Modifier 140 and/or the second modifier 142.

Another embodiment is a system comprising the audio processor 100, the set 110 of loudspeakers and for each set 110 of loudspeakers (for example, for the first loudspeaker 112 and/or the second loudspeaker 114), a signal modifier (for example, the first modifier 140 and/or the second modifier 142) for deriving the loudspeaker signal (for example, the first loudspeaker signal 164 and/or the second loudspeaker signal 166) to be reproduced by the respective loudspeaker from an audio signal 130 using a set of one or more parameters (for example, the first set of one or more parameters 120 and/or the second set of one or more parameters 122) generated for the respective loudspeakers by the audio processor 100. The whole system works together to optimize the listening perception of the listener 170.

In another embodiment, the set 110 of loudspeakers comprises a 3D loudspeaker setup, a legacy speaker setup (horizontal only), a surround loudspeaker setup, loudspeakers build into specific devices or enclosures (e.g. laptops, computer monitors, docking stations, smart-speakers, TVs, projectors, boom boxes, etc.), a loudspeaker array and/or specific loudspeaker arrays known as soundbars. It is also, for example, possible to use virtual loudspeakers (for example, if reflections are used to generate virtual loudspeaker positions). Furthermore, the individual loudspeakers, the first loudspeaker 112 and the second loudspeaker 114, in the set 110 of loudspeakers are representative for alternative designs like loudspeaker arrays or multi-way-loudspeakers. In FIG. 1 the first loudspeaker 112 and the second loudspeaker 114 are shown as an example for the set 110 of loudspeakers, but it is also possible, that only one loudspeaker is present in the set 110 of loudspeakers, or that more than two loudspeakers, like 3, 4, 5, 6, 10, 20 or even more, are present in the set 110 of loudspeakers. Thus, the audio system with the audio processor 100 is compatible for different loudspeaker setups. The audio processor 100 is flexible for generating the set of one or more parameters for different incoming information 150.

Figure 2:
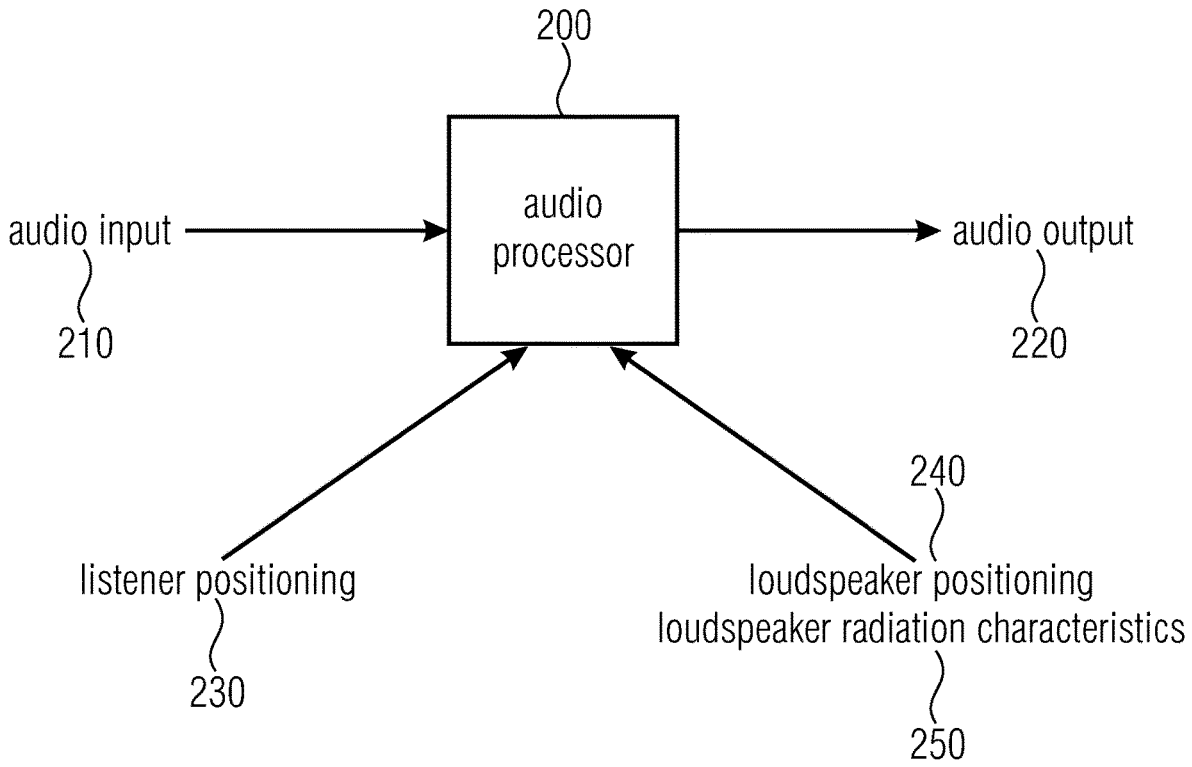
FIG. 2 shows a schematic view of an audio processor according to another embodiment of the present invention.

In another embodiment the set of one or more parameters for the set 110 of loudspeakers may be calculated on the basis of a frequency response of an emission characteristic (loudspeaker radiation characteristics 156) of each of set 110 of loudspeakers for a predetermined emission direction so as to derive a preliminary state of the set of one or more parameters for the set 110 of loudspeakers and the set of one or more parameters for the at least one loudspeaker (for example, the first loudspeaker 112 and/or the second loudspeaker 114) may be modified so that the loudspeaker signal (for example, the first loudspeaker signal 164 and/or the second loudspeaker signal 166) of the at least one loudspeaker (for example, the first loudspeaker 112 and/or the second loudspeaker 114) is derived from the audio signal 130 to be reproduced by, in addition to a modification caused by the preliminary state, spectrally filtering with a transfer function which compensates a deviation of a frequency response of the emission characteristic (loudspeaker radiation characteristics 156) of the at least one loudspeaker (for example, the first loudspeaker 112 and/or the second loudspeaker 114) into a direction pointing from the loudspeaker position 154 of the at least one loudspeaker to the listener positioning 152 from a frequency response of the emission characteristic of the at least one loudspeaker into a predetermined emission direction FIG. 2 shows a schematic view of an audio processor 200 according to an embodiment of the present invention.

FIG. 2 shows a basic implementation of the proposed audio processing. The audio processor 200 receives an audio input 210. The audio input 210 can, for example, be one or more audio channels. The audio processor 200 processes the audio input and outputs the audio input as an audio output 220. The processing of the audio processor 200 is determined by the listener positioning 230 and loudspeaker characteristics (for example, the loudspeaker positioning 240 and the loudspeaker radiation characteristics 250). According to this embodiment, the audio processor 200 receives as incoming information the listener positioning 230, the loudspeaker positioning 240 and the loudspeaker radiation characteristics 250 and bases the processing of the audio input 210 on this information to get the audio output 220. In the processing the audio processor 200, for example, generates a set of one or more parameters and modifies the audio input 210 with this set of one or more parameters to generate a new optimized audio output 220.

Thus, the audio processor 200 optimizes the audio input 210 based on the listener positioning 230, the loudspeaker positioning 240 and the loudspeaker radiation characteristics 250.

Figure 3:
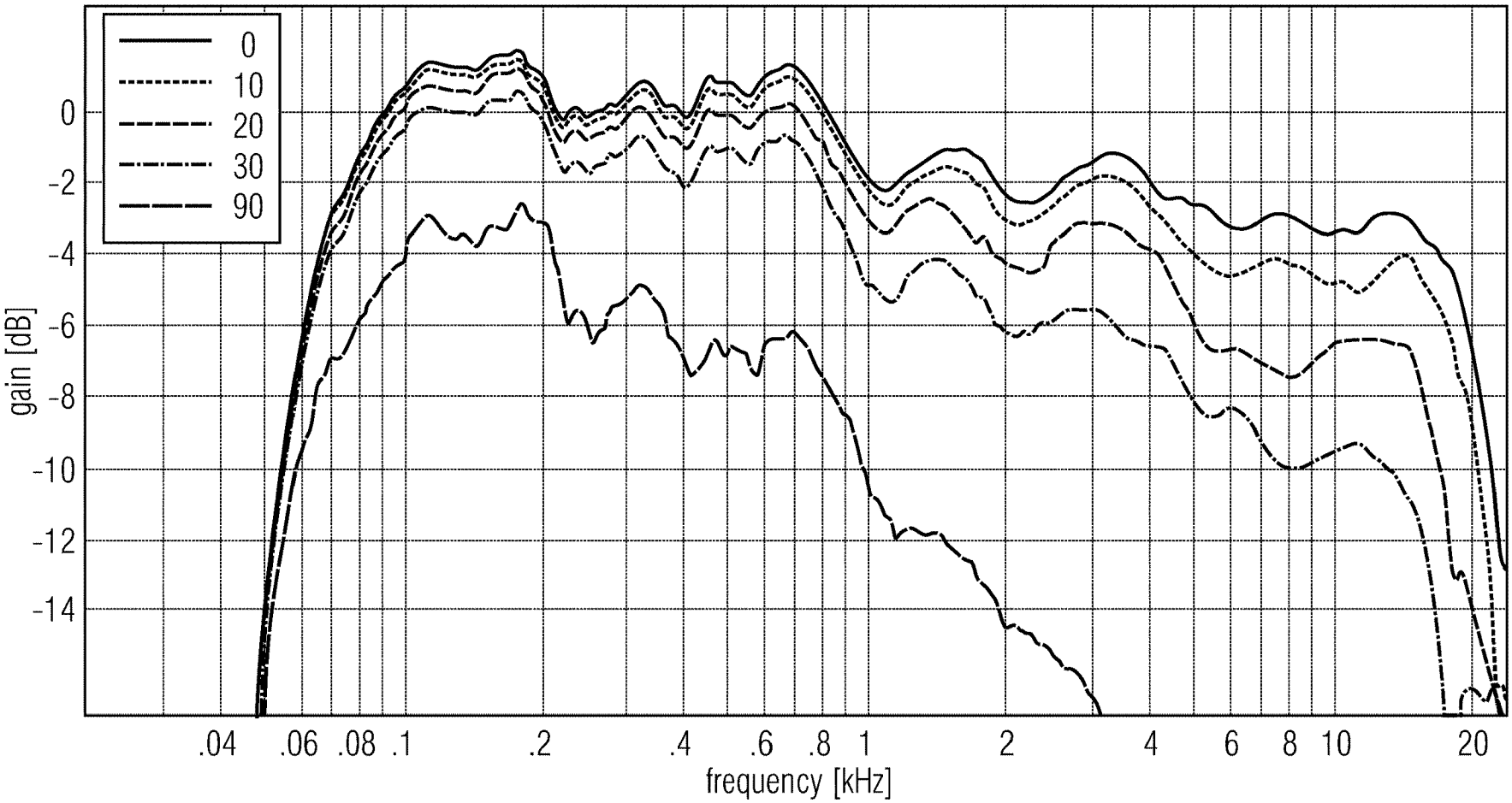
FIG. 3 shows a diagram of the loudspeaker characteristics according to another embodiment of the present invention.

FIG. 3 shows a diagram of the loudspeaker's frequency response. FIG. 3 shows on the abscissa the frequency in kHz and on the ordinate the gain in dB. FIG. 3 shows an example of frequency responses of a loudspeaker at different directions (relative to on-axis forward direction). The more the direction deviates from on-axis, the more high frequencies are attenuated. The frequency responses are shown for different angles.

Figure 4:
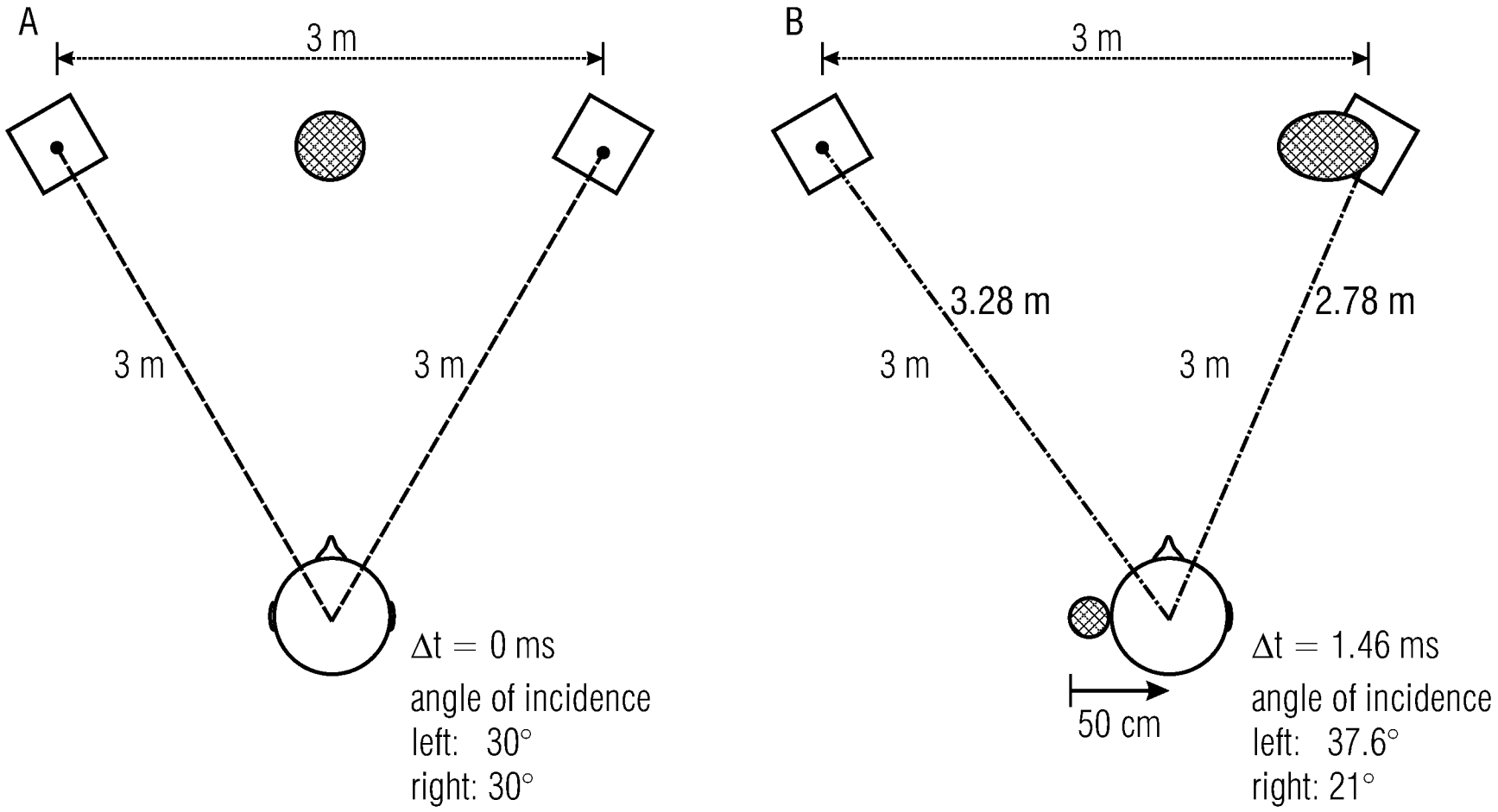
FIG. 4 shows a schematic view of the audio perception of a listener at different listener positions without the loudspeaker characteristic aware rendering concept of the embodiments described herein.

FIG. 4 shows that without the proposed processing the quality of the audio reproduction highly varies with the change of position of a listener, for example, when the listener is moving. The evoked spatial auditory image is unstable for changes of the listening position away from the sweet-spot. The stereophonic image collapses into the closest loudspeaker. FIG. 4 exemplifies this collapse using the example of a single phantom source (grey disc) that is reproduced using a standard two-channel stereophonic playback setup. When the listener moves towards the right, the spatial image collapses and sound is perceived as coming mainly/only from the right loudspeaker. This is undesired. With the present invention (herein described) the listener's position can be tracked and thus, for example, the gain and delay can be adjusted to compensate deviations from the optimal listening position. Accordingly, it can be seen that the present invention clearly outperforms conventional solutions.

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus. Some or all of the method steps may be executed by (or using) a hardware apparatus like, for example, a microprocessor, a programmable computer or an electronic circuit. In some embodiments, one or more of the most important method steps may be executed by such an apparatus.

Depending on certain implementation requirements, embodiments of the invention can be implemented in hardware or in software. The implementation can be performed using a digital storage medium, for example, a floppy disk, a DVD, a Blu-Ray, a CD, a ROM, a PROM, an EPROM, an EEPROM or a FLASH memory, having electronically readable control signals stored thereon, which cooperate (or are capable of cooperating) with a programmable computer system such that the respective method is performed. Therefore, the digital storage medium may be computer readable.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may, for example, be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein. The data carrier, the digital storage medium or the recorded medium are typically tangible and/or non-transitionary.

A further embodiment of the inventive method is, therefore, a data stream or a sequence of signals representing the computer program for performing one of the methods described herein. The data stream or the sequence of signals may, for example, be configured to be transferred via a data communication connection, for example, via the Internet.

A further embodiment comprises a processing means, for example, a computer, or a programmable logic device, configured to or adapted to perform one of the methods described herein.

A further embodiment comprises a computer having installed thereon the computer program for performing one of the methods described herein.

A further embodiment according to the invention comprises an apparatus or a system configured to transfer (for example, electronically or optically) a computer program for performing one of the methods described herein to a receiver. The receiver may, for example, be a computer, a mobile device, a memory device or the like. The apparatus or system may, for example, comprise a file server for transferring the computer program to the receiver.

In some embodiments, a programmable logic device (for example, a field programmable gate array) may be used to perform some or all of the functionalities of the methods described herein. In some embodiments, a field programmable gate array may cooperate with a microprocessor in order to perform one of the methods described herein. Generally, the methods may be performed by any hardware apparatus.

The apparatus described herein may be implemented using a hardware apparatus, or using a computer, or using a combination of a hardware apparatus and a computer.

The apparatus described herein, or any components of the apparatus described herein, may be implemented at least partially in hardware and/or in software.

The methods described herein may be performed using a hardware apparatus, or using a computer, or using a combination of a hardware apparatus and a computer.

The methods described herein, or any components of the apparatus described herein, may be performed at least partially by hardware and/or by software.

While this invention has been described in terms of several embodiments, there are alterations, permutations, and equivalents which will be apparent to others skilled in the art and which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

REFERENCES

[1] "Adaptively Adjusting the Stereophonic Sweet Spot to the Listener's Position", Sebastian Merchel and Stephan Groth, J. Audio Eng. Soc., Vol. 58, No. 10, October 2010

[2] https://www.princeton.edu/3D3A/PureStereo/Pure_Stereo.html

The invention claimed is:

1. An audio processor configured for generating, for each of a set of one or more loudspeakers, a set of one or more parameters, which determine a derivation of a loudspeaker signal to be reproduced by the respective loudspeaker from an audio signal, based on a listener position and loudspeaker positioning of the set of one or more loudspeakers, wherein the loudspeaker positioning defines the position and orientation of the loudspeakers;

wherein the audio processor is configured to base the generation of the set of one or more parameters for the respective loudspeaker of the set of one or more loudspeakers on a loudspeaker characteristic of at least one of the set of one or more loudspeakers, wherein the loudspeaker characteristic represents an emission-angle dependent frequency response of an emission characteristic of the at least one of the set of one or more loudspeakers, and wherein the audio processor is configured to set each set of one or more parameters separately depending on an angle at which the listener position resides relative to an on-axis forward direction of the respective loudspeaker of the set of one or more loudspeakers.

2. The audio processor according to claim 1, wherein for each of the set of one or more loudspeakers the set of one or more parameters determine the derivation of the loudspeaker signal to be reproduced by modifying the audio signal by delay modification, amplitude modification, and/or a spectral filtering.

3. The audio processor according to claim 1, wherein the audio processor is configured to perform the generation of the set of one or more parameters for the set of one or more loudspeakers, to modify the loudspeaker signal, such that frequency responses are adjusted to compensate frequency response variations due to different angles at which the different loudspeakers emit sound towards the listener position.

4. The audio processor according to claim 1, wherein the audio processor is configured to perform the generation of the set of one or more parameters for the set of one or more loudspeakers such that levels are adjusted to compensate level differences due to distance differences between the different loudspeakers and listener position, to perform the generation of the set of one or more parameters for the set of one or more loudspeakers such that delays are adjusted to compensate delay differences due to distance differences between the different loudspeakers and listener position, and/or to perform the generation of the set of one or more parameters for the set of one or more loudspeakers such that a repositioning of audio objects in a sound mix is applied to render a sound image at a desired positioning.

5. The audio processor according to claim 1, wherein the audio processor is configured such that the set of one or more parameters for the at least one loudspeaker is adjusted so that the loudspeaker signal of the at least one loudspeaker is derived from the audio signal to be reproduced by spectrally filtering with a transfer function which compensates a deviation of a frequency response of an emission characteristic of the at least one loudspeaker into a direction pointing from the loudspeaker position of the at least one loudspeaker to the listener position from the frequency response of the emission characteristic of the at least one loudspeaker into the on-axis forward direction.

6. The audio processor according to claim 1, wherein the listener position defines a listener's horizontal position.

7. The audio processor according to claim 1, wherein the listener position defines a listener's head position in three dimensions.

8. The audio processor according to claim 1, wherein the listener position defines a listener's head position and head orientation.

9. The audio processor according to claim 1, configured to receive the listener position in real-time, and adjust delay, level, and frequency responses in real-time.

10. The audio processor according to claim 1, wherein the audio processor supports multiple predefined listener positions, wherein the audio processor is configured to perform the generation of the set of one or more parameters for the set of one or more loudspeakers by precomputing the set of one or more parameters for the set of one or more loudspeakers for each of the multiple predefined listener positions.

11. The audio processor according to claim 1, wherein the audio processor is configured to receive incoming information from a sensor configured to acquire the listener position by a camera, a gyrometer, an accelerometer and/or acoustic sensors and generate the set of one or more parameters based on the incoming information.

12. The audio processor according to claim 1, configured to perform the generation based on a set of more than one listener positions.

13. The audio processor according to claim 1, wherein the set of one or more parameters define a shelving filter.

14. The audio processor according to claim 1, configured to perform the generation for each loudspeaker separately depending on the listener position relative to the respective loudspeaker or depending on differences of a relative location of the listener position relative to the loudspeakers.

15. The audio processor according to claim 1, wherein the set of one or more loudspeakers comprises a 3D loudspeaker setup, a legacy loudspeaker setup, a loudspeaker array, a soundbar and/or virtual loudspeakers.

16. The audio processor according to claim 1, wherein loudspeaker characteristics are measured or taken from databases or approximated by simplified models.

17. A system comprising the audio processor according to claim 1, the set of one or more loudspeakers and, for each set of one or more loudspeakers, a signal modifier for deriving the loudspeaker signal to be reproduced by the respective loudspeaker from an audio signal using a set of one or more parameters generated for the respective loudspeakers by the audio processor.

18. A method for operating an audio processor, wherein a set of one or more parameters are generated, for each of a set of one or more loudspeakers, which determine a derivation of a loudspeaker signal to be reproduced by the respective loudspeaker from an audio signal, based on a listener position and loudspeaker positioning of the set of one or more loudspeakers, wherein the loudspeaker positioning defines the position and orientation of the loudspeakers;

wherein the audio processor bases the generation of the set of one or more parameters of the respective loudspeaker of the set of one or more loudspeakers on a loudspeaker characteristic of at least one of the set of one or more loudspeakers, wherein the loudspeaker characteristic represents an emission-angle dependent frequency response of an emission characteristic of the at least one of the set of one or more loudspeakers, and wherein the audio processor sets each set of one or more parameters separately depending on an angle at which the listener position resides relative to an on-axis forward direction of the respective loudspeaker of the set of one or more loudspeakers.

19. A non-transitory digital storage medium having stored thereon a computer program for performing a method for operating an audio processor, wherein a set of one or more parameters are generated, for each of a set of one or more loudspeakers, which determine a derivation of a loudspeaker signal to be reproduced by the respective loudspeaker from an audio signal, based on a listener position and loudspeaker positioning of the set of one or more loudspeakers, wherein the loudspeaker positioning defines the position and orientation of the loudspeakers;

wherein the audio processor bases the generation of the set of one or more parameters of the respective loudspeaker of the set of one or more loudspeakers on a loudspeaker characteristic of at least one of the set of one or more loudspeakers, wherein the loudspeaker characteristic represents an emission-angle dependent frequency response of an emission characteristic of the at least one of the set of one or more loudspeakers, and wherein the audio processor sets each set of one or more parameters separately depending on an angle at which the listener position resides relative to an on-axis forward direction of the respective loudspeaker of the set of one or more loudspeakers, when said computer program is run by a computer.

* * * * *